US006827419B2

(12) United States Patent
Buibas et al.

(10) Patent No.: US 6,827,419 B2
(45) Date of Patent: Dec. 7, 2004

(54) MEDIA ALLIGNMENT METHOD AND SYSTEM

(75) Inventors: Marius Buibas, Chula Vista, CA (US); Jorge Miguel Gomez, San Diego, CA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 24 days.

(21) Appl. No.: 10/256,435

(22) Filed: Sep. 26, 2002

(65) Prior Publication Data

US 2004/0061733 A1 Apr. 1, 2004

(51) Int. Cl.[7] ..... B41J 29/393
(52) U.S. Cl. ..... 347/19; 400/709
(58) Field of Search ..... 347/2, 19, 106, 347/116; 400/74, 708, 709

(56) References Cited

U.S. PATENT DOCUMENTS 4,732,786 A * 3/1988 Patterson et al. ..... 427/261
5,384,592 A * 1/1995 Wong ..... 347/116
5,796,414 A * 8/1998 Sievert et al. ..... 347/19
6,076,915 A * 6/2000 Gast et al. ..... 347/19
6,109,324 A * 8/2000 Bugner et al. ..... 156/378
6,478,401 B1 * 11/2002 King et al. ..... 347/19
6,682,163 B2 * 1/2004 Metzler et al. ..... 347/19
6,755,499 B2 * 6/2004 Castano et al. ..... 347/19

* cited by examiner

*Primary Examiner*—Lamson Nguyen
*Assistant Examiner*—Blaise Mouttet

(57) ABSTRACT

A method and system to align a printer for printing on a media includes detecting a left edge position and a right edge position of a calibration mark while scanning a carriage horizontally over an area holding the media, determining a horizontal coordinate position of the calibration mark according to the left and right edge positions, cross referencing a width measured between the left and right edge positions of the calibration mark with a predetermined vertical coordinate position, and adjusting a horizontal offset in a carriage direction relative to the horizontal coordinate position of the calibration mark and a vertical offset in a media advance direction relative to the vertical coordinate position of the calibration mark.

21 Claims, 4 Drawing Sheets

MEDIA ALLIGNMENT METHOD AND SYSTEM

BACKGROUND OF THE INVENTION

The present invention relates to printers and aligning media for printing on a printer. Some printers use a tray to hold a media for printing and also feed the media into the printer when the printer is prepared to place ink or other marking materials onto the media. This arrangement generally aligns paper and other media adequately for printing and use with a variety of software applications including word processors, spreadsheets, and slide show presentation managers. These applications print text and images on paper and other media and include a relatively wide margin on the edges and the areas around the text or images.

Some software programs perform alignment before printing by moving the images or text relative to the target media size in the printer. For paper, this can be done by identifying the size of the paper media being used (i.e., 8.5"×11" letter size paper) and setting the margins in the application to shift the text or images. Alternatively, software programs also allow images and text to be aligned by moving the images and text left, right, up, or down in the document area. With each of these methods, getting text and images aligned properly in a document is an exercise of trial and error. It typically involves printing a few pieces of paper or media to see if the alignment is correct and then adjusting the position of the images and text on the page within the software applications.

It is difficult to justify this trial and error method of printing when the costs of the media are relatively high and the alignment process is tedious and difficult. This is the case when printing on compact disk (CD), digital video disk (DVD), and video compact disk (VCD) with ink jet printing devices. These media types cost a great deal more than paper or other lower costs media. Also, it is easy to see when the images and text printed on these types of media are not properly aligned as the margin between the circular images and the edge of the media is quite small. Further, symmetry between the images and these various media also makes errors in alignment easy to detect.

Conventional systems rely on the software applications to align the media in the printer by shifting the images as described above. Unfortunately, this can be a time consuming and tedious process given how little tolerance exists when printing on these particular mediums using ink jet printing devices or other printing equipment.

DETAILED DESCRIPTION

Aspects of the present invention facilitate alignment of a printer and a media using a single pass of a line sensor mounted on the printer. The line sensor moves along the carriage direction passing over a calibration mark and automatically aligns the media with the printer in both the carriage and media directions. This is useful with ink jet printing technology as replenishing the ink material generally requires disturbing the ink jet print head alignment or replacing the ink jet print heads altogether. Other printing technologies can also benefit as aligning a print head with a media is always a concern. Further, printing on more expensive media materials like compact disk (CD), digital video disk (DVD), and video compact disk (VCD) is more economical as the automatic alignment operations associated with implementations of the present invention helps ensure more accurate printing and higher output yield for personal and commercial printing applications.

Figure 1:
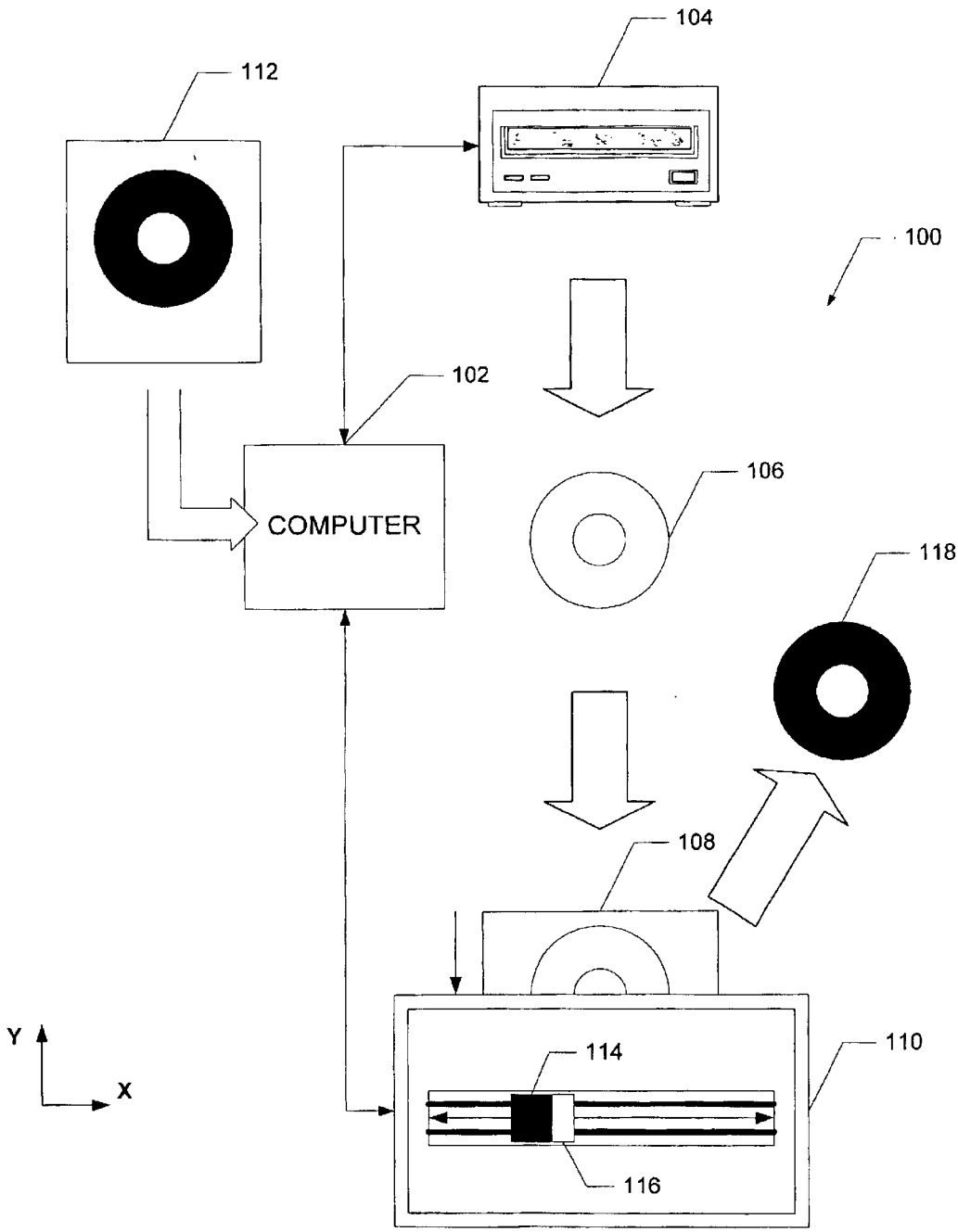
FIG. 1 is a block diagram of a system for mastering digital information on a media and printing on the media in accordance with one implementation of the present invention.

FIG. 1 is a block diagram of a system for mastering digital information on a media and printing on the media in accordance with one implementation of the present invention. One or more implementations of the present invention are designed to print on round media including compact disk (CD), digital video disk (DVD), and video compact disk (VCD). Alternate implementations of the present invention can be used on other media shapes and formats. Hereinafter, the term media includes round media as described above as well as other media shapes and formats that can use automatic printing alignment offered by the one or more implementations of the present invention.

Referring to FIG. 1, system 100 includes a computer 102, a media data writer 104, a media 106, a media tray 108, a media printer 110, a media image 112, a print head 114, and a line sensor 116 used in combination to perform alignment and generate a printed media 118.

In operation, computer 102 instructs media data writer 104 to write or "burn" information onto media 106. Information or content burned onto media 106 can be stored on computer 102 or remotely accessed over a network or the Internet (not shown) and includes music, video, images, and text information. In one implementation, media data writer 104 is an Optical Encoding device that stores video, images, and music content from computer 102 onto media 106. Alternate implementations can be used to stored these or other types of content on different types of media 106 including DVD and CD-writeable media.

Media printer 110 prints directly on media 106 before or after storing the information or content on media 106 as described above. In one implementation, media printer 110 is an ink jet printer using thermal energy to send ink droplets from print head 114 onto media 106. Alternate implementations of the present invention use ink jet printers with piezoelectric technology rather than thermal energy to transmit the ink droplets. In either alternative, ink droplets printed on media 106 correspond to media image 112; typically a label identifying the content stored on media 106. For example, the label can include text, images, and other information related to the music, videos, images, or topics stored on media 106 to assist in identifying the information. To ensure the label on media 106 is aligned properly, implementations of the present invention use line sensor 116 to detect a calibration mark while traveling with the print head along the x-axis.

Figure 2A:
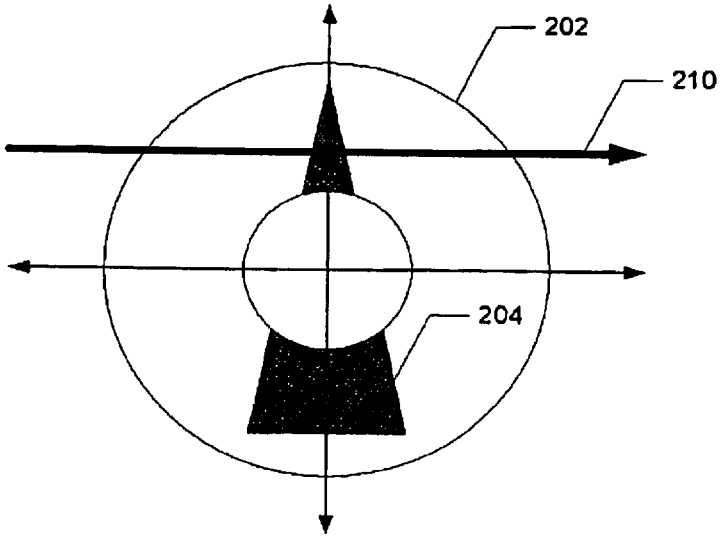
FIG. 2A and FIG. 2B illustrate examples of a calibration mark designed in accordance with implementations of the present invention and impressed upon media and/or other portions of a printer.
Figure 2B:
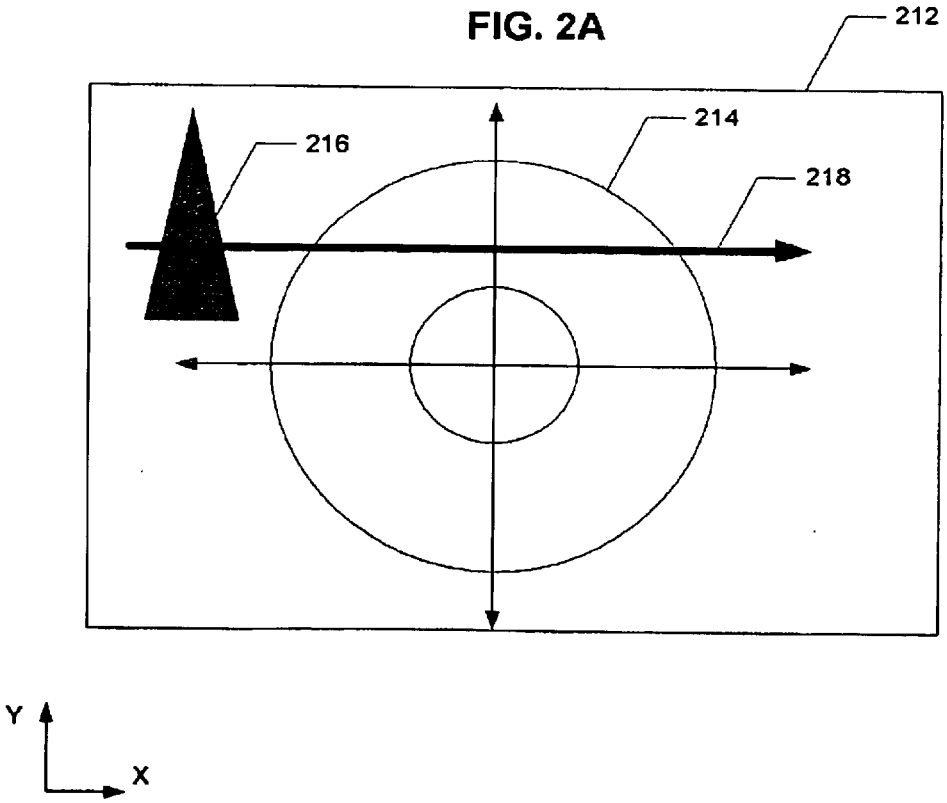

FIG. 2A and FIG. 2B illustrate examples of a calibration mark designed in accordance with implementations of the present invention. The calibration mark can be printed on a media inserted into the printer or placed on a tray portion or other portion of the printer and used for calibration. In one implementation illustrated in FIG. 2A, a disk 202 is impressed with a calibration mark 204 centered and positioned under line sensor path 210. The line sensor passing over line sensor path 210 during printing and during calibration detects calibration mark 204 on disk 202. Disk 202 can be a CD, DVD, VCD, or any other type of media needing precision printing.

Calibration mark 204 is generally placed in a predetermined position on disk 202 facilitating alignment in accordance with the present invention; in this example calibration mark 204 is a triangle with at least two equal sides (i.e., an isosceles triangle). Alternative shapes having different widths along a vertical axis of the shape can also be used for calibration mark 204 instead of a triangle as illustrated. Details on the implementation and operation of a line sensor as used for detecting information on a printer is described in further detail in U.S. Pat. No. 6,352,332 B1 issued Mar. 5, 2002 entitled, "Method and Apparatus for Printing Zone Print Media Edge Detection" by Steven H. Walker, assigned to the assignee of the present invention and incorporated herein by reference in the entirety for all purposes.

In this implementation, the line sensor performs a single scan across line sensor path 210 detecting calibration mark 204 and determining both the horizontal position and vertical position of disk 202 in a printer. Vertical position is determined as each width across calibration mark 204 corresponds to a specific vertical position on the y-axis along calibration mark 204. Horizontal position of calibration mark 204 is determined by selecting a midway point between the left and right most edges of calibration mark on the x-axis and under line sensor path 210. The line sensor moving across the line sensor path 210 detects the edges associated with calibration mark 204 to determine these values. In one implementation, disk 202 is a "golden CD" having no content or stored data and used for only for occasional alignments as needed. In addition to calibration mark 204 used for alignment purposes, an alternate implementation of the present invention can be used to store or retrieve content or data on disk 202.

An alternate implementation of the present invention illustrated in FIG. 2B impresses calibration mark 216 upon a tray 212 used in a printer to hold a media 214. Tray 212 is part of a printer device (not shown) and used to hold and potentially move media 214 into position for printing. Tray 212 can hold a CD, DVD, VCD, or any other type of media needing precision printing. The printer used for this type of printing is typically an ink jet printer however it could be applied to many other types of printers other than the ink jet printer. In this implementation, calibration mark 216 is an isosceles triangle placed in a predetermined position off-center in tray 212. As previously described, line sensor path 218 passes over calibration mark 216 and determines both the horizontal and vertical positions of calibration mark 204 in relationship to media 214. Alignment adjustments are made relative to the position of an off-center calibration mark 216 in tray 212 rather than centered as provided in FIG. 2A on disk 202.

Figure 3:
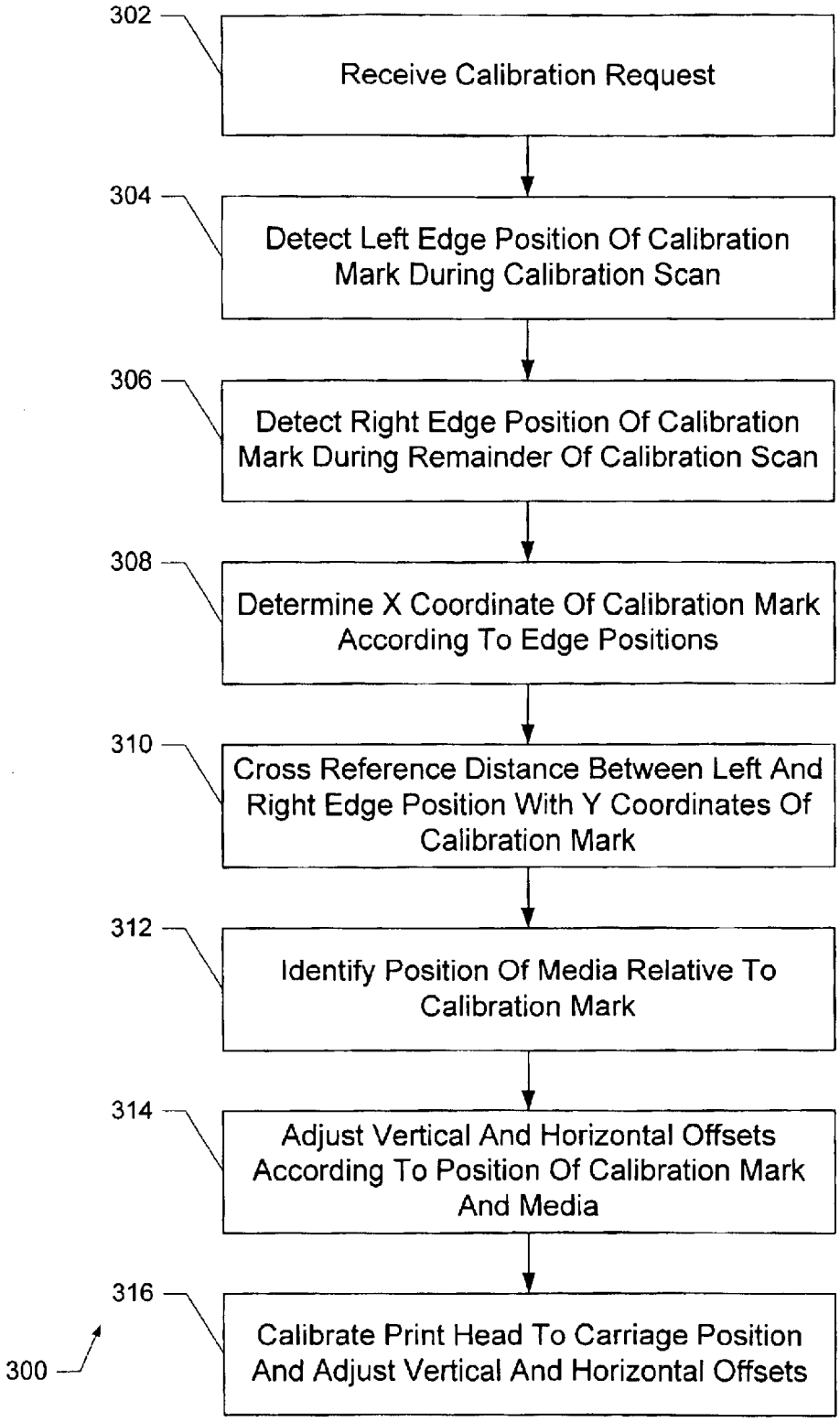
FIG. 3 is a flow chart diagram of the operations used to align a printer device with a calibration mark in accordance to one implementation of the present invention.

FIG. 3 is a flow chart diagram of the operations used to align a printer device with a calibration mark in accordance to one implementation of the present invention. In one implementation, the printer is an ink jet printer however alternate implementations can be adapted and configured to work with other types of printers, plotters, and imaging equipment. In general, the alignment process is performed to ensure proper placement of ink on the media.

To accommodate different media types, implementations of the present invention calibrate the sensor with the media position. This operation accounts for different media dimensions and the relative positions between the media and the sensor position on the carriage. Calibrating the sensor with the media provides an accurate coordinate system for subsequent calibration of the print head to the carriage and ink placement on the media. Offsets in both the carriage axis (X-direction) and media axis (Y-direction) are calculated based on these calibrations and used in printing thereafter.

Initially, the alignment operation 300 receives an indication to align the printer for printing a media (302). The indication to align or calibrate the printer corresponds to a number of different events or signals that occur when using the printer. The indication can cause the alignment to occur automatically on the printer or provide feedback to an operator that the printer needs alignment.

For example, an alignment may be necessary initially when a printer is manufactured or when a print media cartridge is replaced in the printer. Further alignment indications can also occur when the printer is shaken, transported, or serviced, when the printer is turned on, and when the printer switches from black and white to color printing modalities.

Alignment operation 300 detects a left edge position (304) and a right edge position (306) of a calibration mark while scanning a carriage horizontally over an area holding the media. The left edge position and the right edge position of the calibration mark are detected using a line sensor that detects the edges by transmitting and receiving light. Width of the calibration mark is determined by measuring the difference in the x-direction between the right edge and the left edge of the calibration mark.

Using the left and right edge positions, alignment operation 300 determines a horizontal coordinate position of the calibration mark (308). In one implementation, the horizontal coordinate position of the calibration mark corresponds to a midpoint or average value between the left and right edge positions.

Alignment operation 300 cross references the width measured between the left and right edge positions of the calibration mark with a predetermined vertical coordinate position to determine the vertical coordinate position of the calibration mark (310). In one implementation, the calibration mark is a triangle and the width measured across the triangular calibration mark corresponds to one vertical position along the triangle. Accordingly, the vertical position along the calibration mark can be determined by locating the width of the calibration mark in a data storage area or look-up-table (LUT) having pairs of width measurements and vertical positions along a y-axis associated with the specific calibration mark.

The position of the media is identified relative to the calibration mark and the sensor (312). In one implementation, an estimated position of the calibration mark is compared with the detected calibration mark to determine the necessary offset amounts in the X and Y coordinates. As depicted previously, the calibration mark can be impressed to a predetermined position on the media or tray that holds the media during printing. For example, the calibration mark can be centered on a CD-ROM or DVD disk. Alternatively, the calibration mark is impressed in an off-center position on a tray for holding the media during printing. In each of these and other implementations, the position of the calibration mark more accurately determines the position of the media in the printer relative to the sensor and facilitates alignment between the sensor position and the media in a single pass With this position information, alignment operation 300 adjusts a horizontal offset in a carriage direction relative to the horizontal coordinate position of the calibration mark and a vertical offset in a media advance direction relative to the vertical coordinate position of the calibration mark (314). These adjustments allow for more accurate printing on a number of media types including CD, DVD, and VCD.

Further, once the relative position of the sensor and media position are determined then another operation is used to calibrate the print head position relative to the carriage and corresponding vertical and horizontal offsets (316). To perform this calibration using aspects of the present invention, the print head prints a calibration mark on a media consistent with the present invention and then detects the position of the calibration mark in similar manner as described above. This second calibration operation results in proper alignment of the print head to the carriage and ink placement on the carriage. Unlike alternate conventional methods that calibrate the print head relative to the carriage, implementations of the present invention do this type of alignment in a single pass or swath.

Figure 4:
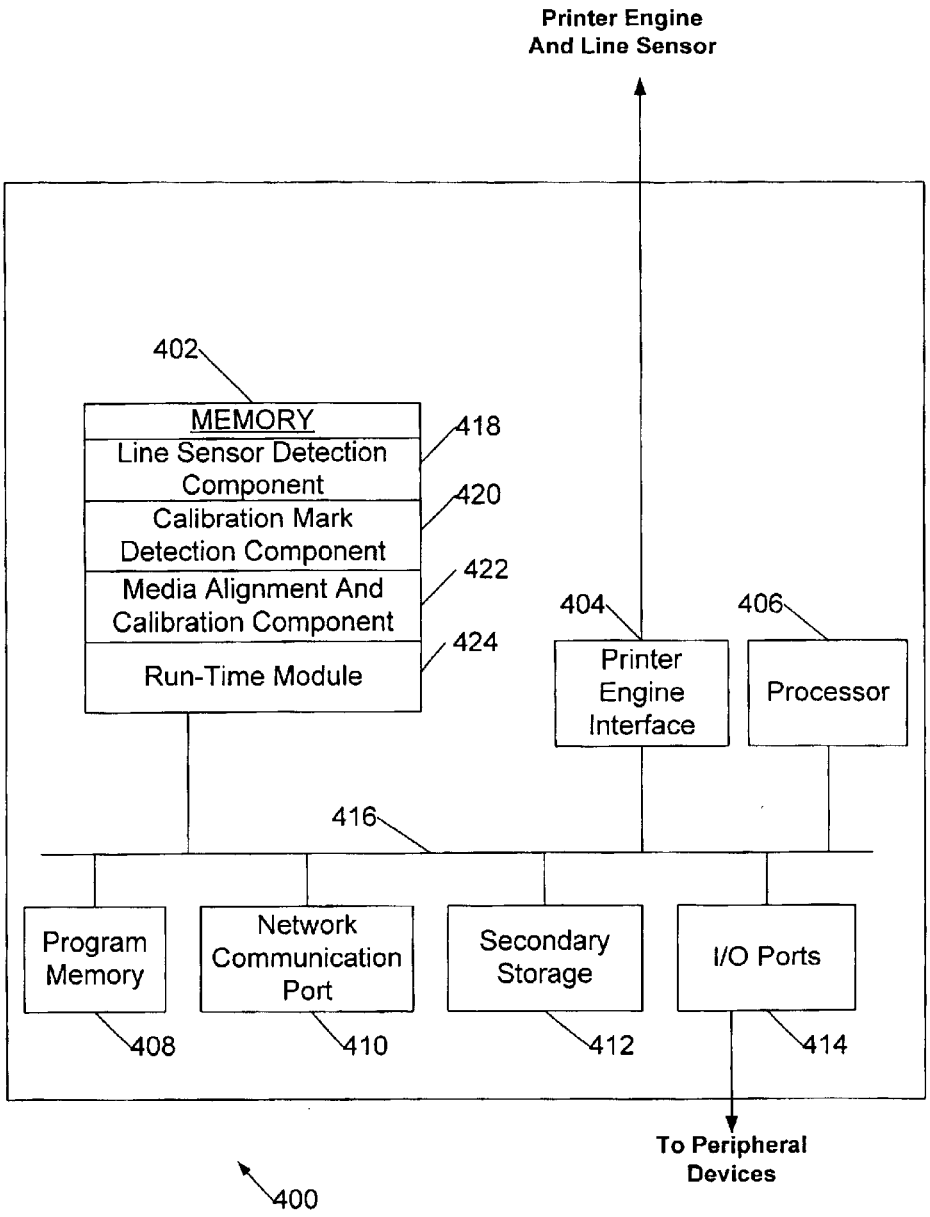
FIG. 4 is a block diagram of an alignment system used to align a printer device in accordance with one implementation of the invention.

FIG. 4 is a block diagram of an alignment system 400 used to align a printer device in accordance with one implementation of the invention. In this example, alignment system 400 includes a memory 402, typically random access memory (RAM), a printer engine interface 404, a processor 406, a program memory 408 (for example, a writable read-only memory (ROM) such as a flash ROM), a network communication port 410, a secondary storage 412, and I/O ports 414 operatively coupled together over bus 416. Alignment system 400 can be preprogrammed, in ROM, for example, or it can be programmed (and reprogrammed) by loading a program from another source (for example, from a floppy disk, a CD-ROM, or another computer).

Depending on the implementation and features, memory 402 includes one or more of the following components: a line sensor detection component 418, a calibration mark detection component 420, a media alignment and calibration component 422 and a run-time module 424 that manages resources of alignment system 400. Line sensor detection component 418 performs the operations for controlling the line sensor on the printer and detecting specific information likes edges in an image and characters in text.

Calibration mark detection component 420 can identify a particular calibration mark and access detailed information on the shape of the calibration mark and specific characteristics useful in determining the orientation or position of the mark relative to the media, the printer, and the print head carriage. For example, calibration mark detection component 420 can access a storage area that has the widths of the calibration mark and the correlation between the widths and the vertical position of the width on the calibration mark along the y-axis.

The coordinates of the calibration mark are then used to align the printer using media alignment and calibration component 422. This component calculates the actual position of the media in the printer and instructions the printer to correct for misalignment by adjusting offsets in the print head carriage direction (x-axis) and the media direction (y-axis). Run-time module can be either a real-time processing operating system or a preemptive interrupt operating system that allocates memory, secondary storage, processor time-slices, and other resources on alignment system 400.

Printer engine interface 404 provides digital and/or analog signal output to a printer engine used in an ink jet printer, laser jet printer, or any other type of printer or image output device. This printer engine interface 404 includes connectivity to a line sensor for detecting a calibration mark and other information. In one implementation, the information provided over printer engine interface 404 is used for printing on the various media types and includes text, images and other types of information.

Secondary storage 412 is suitable for storing executable computer programs, including programs embodying implementations of the present invention, and data including buffers and temporary storage space as need to implement aspects of the present invention. For example, a look-up-table (LUT) can be stored in secondary storage 412 that correlates widths of a calibration mark with vertical positions along the calibration mark along the y-axis.

Input/output (I/O) ports 414 are coupled to alignment system 400 through bus 416. Input/output ports facilitate the receipt and transmission of data (e.g., text, images, videos, and animations) in analog or digital form over communication links such as a serial link, local area network, wireless link, and parallel link. These input/output (I/O) ports also facilitate communication with a wide variety of peripheral devices including scanners, keyboards, pointing devices (such as mouse, touchpad and touchscreen), and other peripheral devices. For example, a scanner device (not shown) connected over input/output (I/O) ports 414 can be used to scan in images for printing on CD-ROM and other media. Alternatively, separate connections (separate buses) can be used to interface with these peripheral devices using a combination of Small Computer Systems Interface (SCSI), Universal Serial Bus (USB), IEEE 1394/Firewire, Personal Computer Memory Card International Association (PCMCIA) or any other protocol suitable for interfacing with the peripheral device being attached to alignment system 400.

To provide for interaction with a user, the invention can be implemented on a computer system having a display device such as a monitor or LCD screen for displaying information to the user and a keyboard and a pointing device such as a mouse or a trackball by which the user can provide input to the computer system. The computer system can be programmed to provide a graphical user interface through which computer programs interact with users. For example, this GUI can be used as a control panel for aligning printers in accordance with implementations of the present invention and managing the printing on media with one or more printers.

Various aspects of the invention can be implemented in digital electronic circuitry, or in computer hardware, firmware, software, or in combinations thereof. Apparatus of the invention can be implemented and computer program product tangibly embodied in a machine-readable storage device for execution by a programmable processor; and method steps of the invention can be performed by a programmable processor executing a program of instructions to perform functions of the invention by operating on input data and generating output. The invention can be implemented advantageously in one or more computer programs that are executable on a programmable system including at least one programmable processor coupled to receive data and instructions from, and to transmit data and instructions to, a data storage system, at least one input device, and at least one output device. Each computer program can be implemented in a high-level procedural or object-oriented programming language, or in assembly or machine language if desired; and in any case, the language can be a compiled or interpreted language. Suitable processors include, by way of example, both general and special purpose microprocessors. Generally, a processor will receive instructions and data from a read-only memory and/or a random access memory. Generally, a computer will include one or more mass storage devices for storing data files; such devices include magnetic disks, such as internal hard disks and removable disks; magneto-optical disks; and optical disks. Storage devices suitable for tangibly embodying computer program instructions and data include all forms of non-volatile memory, including by way of example semiconductor memory devices, such as EPROM, EEPROM, and flash memory devices; magnetic disks such as internal hard disks and removable disks; magneto-optical disks; and CD-ROM disks. Any of the foregoing can be supplemented by, or incorporated in, ASICs (application-specific integrated circuits). For example, implementations of the present invention for performing alignment and calibration can be put in a printer's firmware and called remotely through a software driver residing on a computer. Alternatively, implementations of the present invention can made part of a printer driver that sends/receives commands through the printer's communication ports.

To provide for interaction with a user, the invention can be implemented on a computer system having a display device such as a monitor or LCD screen for displaying information to the user and a keyboard and a pointing device such as a mouse or a trackball by which the user can provide input to the computer system. The computer system can be programmed to provide a graphical user interface through which computer programs interact with users.

While specific embodiments have been described herein for purposes of illustration, various modifications may be made without departing from the spirit and scope of the invention. For example, a calibration mark is impressed upon a media tray and one or more different types of media however the calibration mark can appear in other places as long as a line sensor can detect the calibration mark and align the printer. Further, implementations of the present invention not only work with compact disc (CD), digital video disc (DVD), and video compact disc (VCD) but also work with other rigid and non-rigid types of media. Accordingly, the invention is not limited to the above-described implementations, but instead is defined by the appended claims in light of their full scope of equivalents.

What is claimed is:

1. A method of aligning a printer for printing on a media, comprising:

detecting a left edge position and a right edge position of a calibration mark while scanning a carriage horizontally over an area holding the media;

determining a horizontal coordinate position of the calibration mark according to the left and right edge positions;

cross referencing a width measured between the left and right edge positions of the calibration mark with a predetermined vertical coordinate position; and adjusting a horizontal offset in a carriage direction relative to the horizontal coordinate position of the calibration mark and a vertical offset in a media advance direction relative to the vertical coordinate position of the calibration mark.

2. The method of claim 1 further comprising the step of receiving an indication to calibrate the printer, wherein the indication is selected from a set of events including: when a print media cartridge is replaced in the printer, when the printer is shaken, when the printer is turned on, when the printer switches from black and white to color printing modalities, and when a new media is installed in the printer for printing.

3. The method of claim 1 further comprising calibrating a sensor position relative the media using a calibration mark impressed to a predetermined position on the media.

4. The method of claim 1 further comprising calibrating a sensor position relative the media using a calibration mark impressed to a predetermined position on a tray for holding the media during printing.

5. The method of claim 1 further comprising printing the calibration mark onto the media through a print head and then using the calibration mark to calibrate the print head position relative to the media.

6. The method of claim 1 wherein determining a horizontal coordinate position of the calibration mark according to the left and right edge positions comprises selecting a midpoint between the left and right edge positions as the horizontal coordinate position.

7. The method of claim 1 wherein the width measured across the calibration mark corresponds to one vertical position along a vertical axis of the calibration mark.

8. The method of claim 1 wherein the calibration mark is a triangle and the width measured across the calibration mark corresponds to one vertical position along the triangle.

9. The method of claim 1 wherein the cross referencing comprises:

locating the width of the calibration mark in an entry in a data storage area having one or more width measurements; and retrieving a vertical coordinate position from the entry in the storage area that corresponds to the measured width of the calibration mark.

10. The method of claim 1 wherein the media is selected from a group of media including: compact disc (CD), digital video disc (DVD), and video compact disc (VCD).

11. The method of claim 1 wherein the printer is an ink jet printer.

12. A method of processing a media that facilitates aligning a printer, comprising:

selecting a predetermined position to place a calibration mark that facilitates calibrating both a horizontal position and a vertical position of the media in a printer with a single scanning across the media with a sensor device, wherein the calibration mark has a shape with different widths along an x-axis measured between a left edge and a right edge of the shape and each of the widths are to be cross-referenced during alignment to a specific predetermined vertical position along a y-axis of the shape on the media;

receiving the media for impressing the calibration mark; and impressing the calibration mark in the predetermined position on the media.

13. A round media that facilitates alignment of a printer, comprising:

a coating on the surface of the round media capable of receiving a marking material from the printer; and a calibration mark impressed at a predetermined position on the surface of the round media, the calibration mark having a shape with different widths along an x-axis measured between the left edge and right edge and each width corresponding to a specific vertical position along a y-axis of the shape.

14. The round media of claim 13 wherein a width measured between the left edge and the right edge of the calibration mark corresponds to one vertical position along the calibration mark.

15. The round media of claim 13 wherein the calibration mark is a triangle and the width measured across the calibration mark corresponds to one vertical position along the triangle.

16. The round media of claim 13 wherein the round media is selected from a group of round media including: compact disc (CD), digital video disc (DVD), and video compact disc (VCD).

17. The round media of claim 13 wherein the printer is an ink jet printer.

18. A media tray in a printer capable of holding a media and facilitating the alignment of a printer, comprising:

a calibration mark impressed at a predetermined position on the surface of the media tray, the calibration mark having a shape with different widths along an x-axis measured between a left edge and a right edge of the shape and each of the widths corresponding to a specific vertical position along a y-axis of the shape.

19. The media tray of claim 18 wherein the width measured between the left edge and the right edge of the calibration mark corresponds to one vertical position along the calibration mark.

20. The media tray of claim 18 wherein the calibration mark is a triangle and the width measured across the calibration mark corresponds to one vertical position along the triangle.

21. An apparatus for aligning a printer to print on a media, comprising:

means for detecting a left edge position and a right edge position of a calibration mark while scanning a carriage horizontally over an area holding the media;

means for determining a horizontal coordinate position of the calibration mark according to the left and right edge positions;

means for cross referencing a width measured between the left and right edge positions of the calibration mark with a predetermined vertical coordinate position; and means for adjusting a horizontal offset in a carriage direction relative to the horizontal coordinate position of the calibration mark and a vertical offset in a media advance direction relative to the vertical coordinate position of the calibration mark.

* * * * *